US009162103B2

(12) United States Patent
Lorusso

(10) Patent No.: US 9,162,103 B2
(45) Date of Patent: Oct. 20, 2015

(54) GYMNASTIC MACHINE

(75) Inventor: Marco Lorusso, Civitella di Romagna (IT)

(73) Assignee: TECHNOGYM S.P.A., Gambettola (FC) (IT)

( * ) Notice: Subject to any disclaimer, the term of this patent is extended or adjusted under 35 U.S.C. 154(b) by 832 days.

(21) Appl. No.: 13/100,337

(22) Filed: May 4, 2011

(65) Prior Publication Data

US 2011/0275497 A1 Nov. 10, 2011

(30) Foreign Application Priority Data

May 4, 2010 (IT) ..... RA10A0014

(51) Int. Cl.
*A63B 21/00* (2006.01)
*A63B 23/04* (2006.01)
*A63B 21/062* (2006.01)

(52) U.S. Cl.
CPC ..... *A63B 21/1492* (2013.01); *A63B 21/1469* (2013.01); *A63B 21/154* (2013.01); *A63B 21/159* (2013.01); *A63B 23/0405* (2013.01); *A63B 21/062* (2013.01); *A63B 2023/0411* (2013.01)

(58) Field of Classification Search
USPC ..... 482/99–103, 135–138, 908
See application file for complete search history.

(56) References Cited

U.S. PATENT DOCUMENTS 4,834,367 A 5/1989 Salyer
5,362,290 A * 11/1994 Huang ..... 482/100
5,643,152 A * 7/1997 Simonson ..... 482/100
5,823,920 A * 10/1998 Grider ..... 482/100
6,251,052 B1 * 6/2001 Simonson ..... 482/100
D513,289 S * 12/2005 Panatta ..... D21/676
7,070,545 B2 * 7/2006 Lull et al. ..... 482/100
7,083,554 B1 * 8/2006 Lo Presti ..... 482/137
7,101,327 B1 9/2006 Baumler
7,717,833 B1 * 5/2010 Nelson et al. ..... 482/100
7,846,075 B2 * 12/2010 Ish, III ..... 482/92
7,998,036 B2 * 8/2011 Ish, III ..... 482/100
8,128,538 B2 * 3/2012 Lines ..... 482/100
8,251,877 B2 * 8/2012 Rasmussen et al. ..... 482/100
8,523,744 B2 * 9/2013 Hongo et al. ..... 482/131

FOREIGN PATENT DOCUMENTS

EP 1442768 A1 8/2004

OTHER PUBLICATIONS

European Search Report dated Dec. 14, 2010.

* cited by examiner

*Primary Examiner* — Stephen Crow
(74) *Attorney, Agent, or Firm* — Abelman, Frayne & Schwab

(57) ABSTRACT

Regulating group for adjusting the initial operating position of an interface associated with a gymnastic machine comprising a frame; a load group connected to the interface through a respective transmission device; a support group designed to carry the interface movable relative to the frame; the regulating group comprising a return device suitable, in use, to define, at the initial operating position, a stop for the movement of the interface relative to the frame; wherein the return device can be connected, in use, to the transmission device through a given coupling, so that to each variation in the initial operating position actuated through the return device corresponds a respective given variation in the operating configuration of the transmission device.

16 Claims, 3 Drawing Sheets

GYMNASTIC MACHINE

FIELD OF THE INVENTION

The present invention relates to a gymnastic machine. In particular, the present invention relates to a machine provided with a regulating group for adjusting an operating position of a respective interface. In more detail, the present invention relates to a gymnastic machine provided with a regulating group for adjusting an operating position of a respective interface, preferably usable for executing squat exercises.

BACKGROUND TO THE INVENTION

In the field of gymnastic machines the use of regulating devices is well known to change in a given manner characteristics of the operating configuration of a gymnastic machine, so as to adapt them, before the use or during it, to the user's anthropometric proportions and/or to the desired training modes. In particular, with reference to the gymnastic machines provided with an interface suitable, in use, to move in the space between an initial operating position, i.e. an operating position of starting the exercise, and a final operating position, i.e. an operating position of stopping the exercise, regulating devices are well known, which can be used to define selectively the initial operating position, selecting it among a plurality of possible operating positions. For instance, the gymnastic machines for executing leg extension and leg curl exercises are usually provided with regulating devices for adjusting the initial operating position of an interface carried in a freely rotatable manner by the frame of the gymnastic machine and comprising a cylindrical cushion acting as an abutment member for the legs during the execution of this type of exercises. These regulating devices generally comprise a first regulating member, integrally coupled to the interface, and a second regulating member, carried slidable by the frame of the gymnastic machine and connected to a respective load group through a mechanical transmission. These first and second members are designed so that they can be selectively coupled in a plurality of distinct operating configurations to connect the interface and the respective cylindrical cushion to the load group through the mechanical transmission, and to each of these operating configurations corresponds a respective initial operating position of the interface. For example, again with reference to the machines for executing leg extension or leg curl exercises, these first and second regulating member can comprise respectively a metallic plate integral with the rotatable interface and provided with a plurality of stepped holes, and a blocking pin integrally coupled to a traction cable connected to the load group and designed to engage stably one of the holes obtained in the respective metallic plate.

Analogously, the patent document U.S. Pat. No. 6,251,052 also discloses a gymnastic machine for executing squat exercises provided with a regulating device for adjusting the initial operating position of a respective interface. In particular, this machine comprises a frame, a gravitational load group, an interface, which is carried in a freely rotatable manner by the frame through a respective support arm and can be engaged, in use, by the user's back and shoulders, and a lever, which is carried by the frame rotatable around the same axis of rotation of the support arm and is connected to the load group. The gymnastic machine according to the patent document '052 furthermore comprises a regulating device for adjusting the rest initial position of the interface, comprising a device suitable to couple integrally the support arm for the interface with the first lever associated with the load group according to a plurality of operating configurations that can be selected by the user substantially at will. In particular, this coupling device comprises an arched portion obtained in a single piece with the first lever and presenting a plurality of stepped through holes, and a blocking pin that, in use, is maintained engaged in one of the holes of the arched portion by a respective feeder.

The technical solution described in the patent document '052 for executing squat exercises presents some drawbacks, which are also similar to the drawbacks present in the technical solutions previously described above with reference to machines for executing leg extension and leg curl exercises. In particular, the design choice to couple an interface or a support member for the interface directly to a transmission mechanism connected to the load group requires that the regulating device for adjusting the initial operating position of the interface be arranged near the location of the user during the execution of the exercises by the user. Therefore, in the patent document '052 the regulating device is in a potentially dangerous location because it can be accidentally engaged by the user during the execution of the exercises. Furthermore, the use of a direct and selectively releasable mechanical coupling such as those described in the examples cited above, requires that the regulating device for adjusting the initial operating position of the interface generally includes significant size and bulk.

An Alternative solution is disclosed in the patent document U.S. Pat. No. 4,834,367 which is relative to a machine to perform both wrist supination and pronation exercises acting on a couple of handles symmetrically carried by a rotatable shaft against the action of a gravitational load group. In particular, the machine according to document '367 allows the user to regulate the initial position of the shaft by adjusting the vertical position, along a respective post associated to the frame of the machine, of the device that supports the shaft in a rotatable way.

However also this solution presents some drawbacks, e.g. the user should stop is training session, leave the exercise station and interact with the gravitational load group to couple rigidly its weight stack to the frame of the machine each time he/she wants to adjust the initial position of the rotatable exercise shaft. Clearly this operation is uncomfortable and presents some risk as in the previous case of document '052

In view of the above description, the problem of adjusting the initial operating position of the interface of a gymnastic machine in an easy and safe way for each respective user of the gymnastic machine is therefore actually solved in an unsatisfactory manner and thus represents a challenge for the applicant, which has set itself the aim of producing a gymnastic machine provided with a regulating group for adjusting the initial operating position of a respective interface that is easy and safe and presents reduced bulk.

In particular, in view of the above described situation, it would be desirable to have available a regulating group for adjusting the initial operating position of the interface of a gymnastic machine that, even if arranged in a remote position from the exercising station of the gymnastic machine, can be easily actuated and controlled by a user who is in this exercising station.

SUMMARY OF THE PRESENT INVENTION

The present invention relates to a gymnastic machine. In particular, the present invention relates to a machine provided with a regulating group for adjusting an operating position of a respective interface. In more detail, the present invention relates to a gymnastic machine provided with a regulating group for adjusting an operating position of a respective interface, preferably usable for executing squat exercises.

The object of the present invention is to obtain a gymnastic machine provided with a regulating group for adjusting the initial operating position of a respective interface for a user's given body portion, which allows the above mentioned drawbacks to be solved, and which is suitable to satisfy a plurality of requirements that to date have still not been addressed, and therefore suitable to represent a new and original source of economic interest, capable of modifying the current market of the gymnastic machines.

According to the present invention, a gymnastic machine is provided, whose main characteristics will be described in at least one of the appended claims.

A further object of the present invention is to provide a simple and safe device, which presents reduced bulk, for adjusting an initial operating position of an interface of a gymnastic machine.

According to the present invention, a regulating group is provided, whose main characteristics will be described in at least one of the appended claims.

BRIEF DESCRIPTION OF DRAWINGS

Further characteristics and advantages of the gymnastic machine and of the respective regulating group according to the present invention will be more apparent from the description below, set forth with reference to the accompanying drawings, which illustrate some non-limiting examples of embodiment, in which identical or corresponding parts of the device are identified by the same reference numbers. In particular.

DETAILED DESCRIPTION OF THE PRESENT INVENTION

Figure 1:
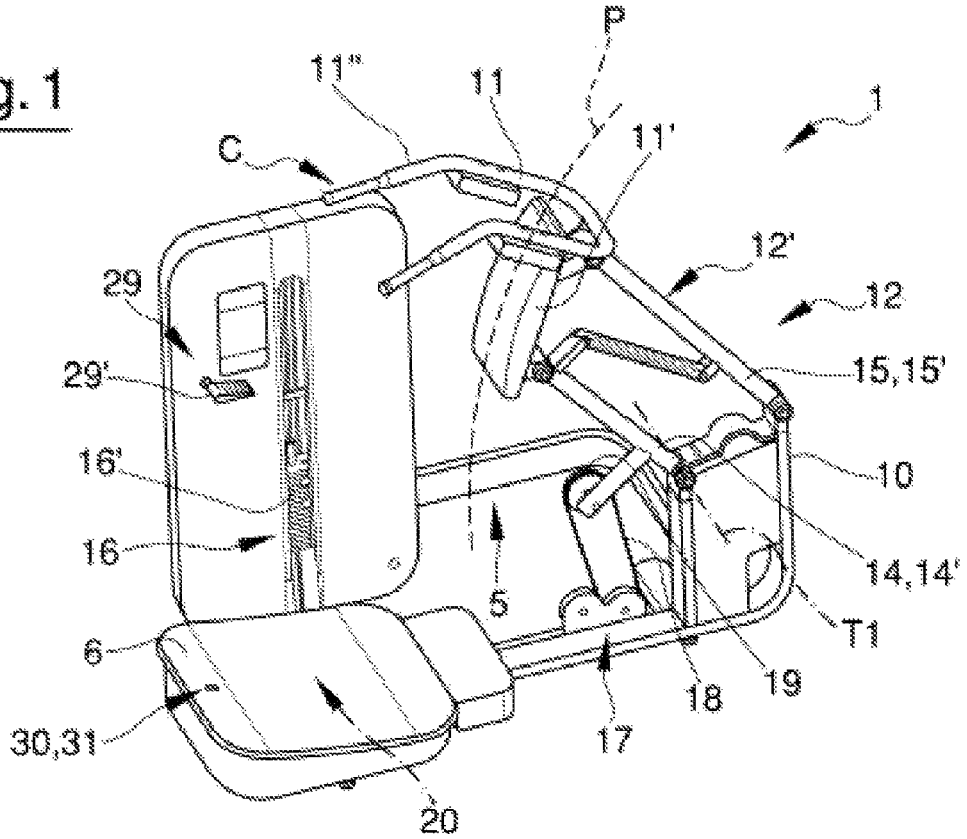
FIG. 1 is a schematic perspective view of a first preferred embodiment of a gymnastic machine according to the present invention.

In FIG. 1, number 1 indicates, in its entirety, a first preferred embodiment of a gymnastic machine comprising a frame 10, a load group 16, preferably, although without limitation, of the gravitational type, and an interface 11 associated with a respective exercising station 5, shaped to be engaged, in use, by a given body portion of a user of the gymnastic machine 1 and connected to the load group 16 through a respective transmission device 17, preferably of the mechanical type. This interface 11 is carried movable by the frame 10 though a support group 12 and is designed to allow the user of the gymnastic machine 1 to perform respective gymnastic exercises against the resistant action of the load group 16. At this point it should be noted that hereinafter reference will be made mainly to a gymnastic machine 1 specifically designed for the execution of squat exercises without however limiting the scope of the present invention and, in particular, of the regulating group according to the present invention, which can be freely used in any type of gymnastic machine provided with an interface 11 as that described above.

With particular reference to FIG. 1, the interface 11 comprises preferably, although without limitation, a rest member 11' for the user's back and a substantially U-shaped abutment member 11", arranged substantially transversally to the rest member 11' and designed to be engaged, in use, by the user's shoulders and/or upper limbs. To this end, as illustrated in FIG. 1, the abutment member 11" can comprise preferably a pair of rest cushions or paddings for the shoulders and/or a pair of handles for the user's hands.

Figure 2:
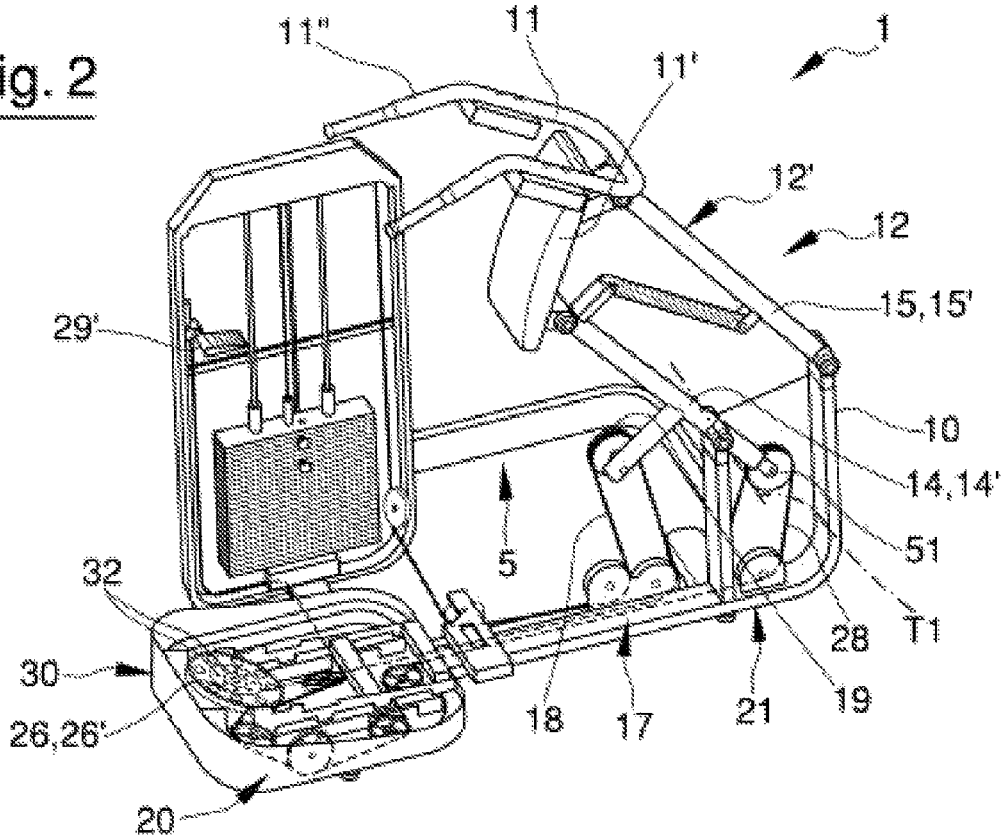
FIG. 2 is a perspective view of FIG. 1 with some parts removed for the sake of clarity.
Figure 3:
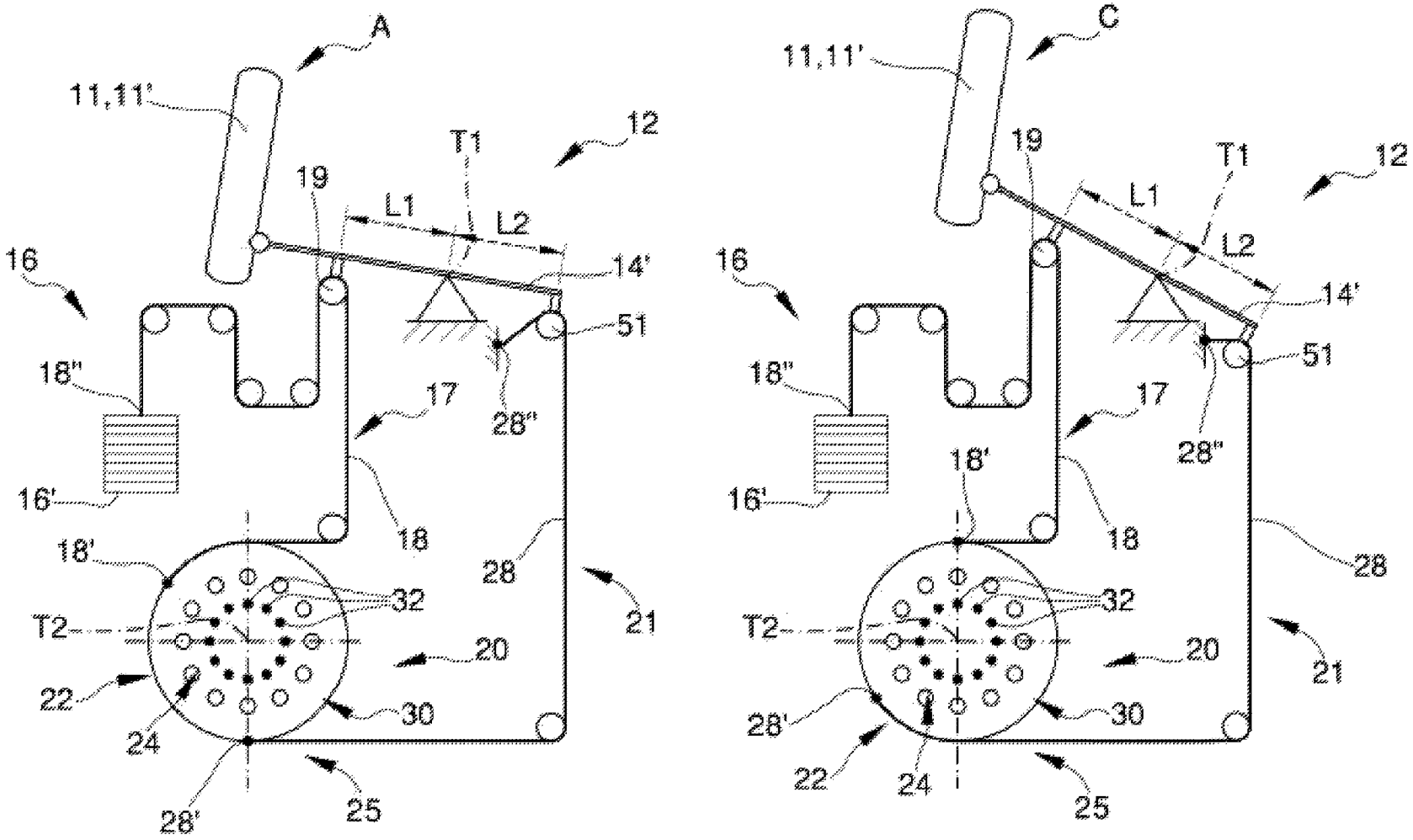
FIG. 3 schematically illustrates a regulating group according to the present invention, represented in two distinct operating phases.

Again with reference to FIG. 1, it should be noted that the support group 12 comprises preferably, although without limitation, at least one first support member 14 carried in a freely rotatable manner by the frame 10 and stably coupled to the interface 11 in a given manner. In particular, the first support member 14 preferably comprises a first first-class lever 14', carried rotatable by the frame 10 around a respective first axis T1 of rotation and presenting the respective end arranged at the side of the exercising station 5 hinged to the interface 11. In more detail, the support group 12 for the interface 11 preferably presents a four-bar linkage 12' comprising the first lever 14'; a second support member 15, for example a second lever 15', presenting a respective first end carried in a freely rotatable manner by the frame 10 and a second end hinged to the interface 11; a portion of the frame 10 arranged between the joining points between the first and the second levers 14' and 15' and the frame 10; and a portion of the interface 11, for instance a frame portion of the support member 11'. This four-bar linkage 12' forces the interface 11 to move along a given trajectory P between an initial operating position A, that can be defined substantially at will by the user, as it will be better described below, and a stop operating position C, illustrated in FIG. 2 and generally defined by the structural configuration of the support group 12. With particular reference to FIGS. 2 and 3, it should be noted that hereinafter the initial operating position A of the interface 11 will be considered as arranged at a lower height relative to the corresponding final operating position, without however limiting the general scope of the present invention. With reference to FIGS. 2 and 3 again, the gymnastic machine 1 is provided with a return device 21 suitable, in use, to exert an unilateral constraining action on the rotation of the first lever 14' to prevent the interface 11 from continuing its descending stroke along the trajectory P beyond the selected initial operating position A. In particular, the return device 21 comprises a substantially non extendable first flexible element 28, for example a first metallic cable 28, which presents a respective first end 28' rigidly connected to a first pulley 26' carried in a freely rotatable manner by the frame 10 around a respective second axis T2 of rotation, and which is mechanically coupled to the first lever 14' at opposite side from the interface 11 relative to the first axis T1 of rotation. This first cable 18 presents preferably, although without limitation, a respective second end 28" rigidly connected to the frame 10, and is associated in a freely slidable manner to the first lever 14' through the interposition of a return element 51 of the known type, for example a pulley carried in a freely rotatable manner by the first lever 14' near a respective end position arranged at opposite side from the interface 11 relative to the first axis T1 of rotation. In this regard, it should be noted that, from a functional viewpoint, the return device 21 is suitable to exert a substantially equivalent constraining action on the rotation of the first lever 14' even if the second end 28" is rigidly coupled to the end of the first lever 14' arranged at opposite side from the interface 11.

The return device 21 furthermore comprises a blocking device 22 for blocking the first pulley 26' suitable, in use, to force this first pulley 26' in a respective given angular operating position. This blocking device 22 comprises preferably, although without limitation, a plurality of holes 24 obtained in a stepped manner in the first pulleys 26' along a respective inner circumference, and a blocking pin 23 dimensioned for shape engaging each hole 34, and carried integrally by this frame 10 through a feeder 23', suitable, in use, to maintain stably the blocking pin 23 engaged with a respective given hole 34 so as to engage the first pulley 26' with the frame 10 and thus prevent any rotation thereof. In view of the above description it is therefore clearly apparent that, when the first pulley 26' is fixed to the frame 10 by the blocking device 22, the longitudinal extension of the first cable 28 defines a stop position for the rotary motion of the first lever 14' around the respective first axis T1 and therefore defines at the same time a given initial operating position A of the interface 11. At this point, with reference to FIGS. 1 and 2, it should be noted that the return device 21 comprises a control device 29 for controlling the blocking device 22, through which the user of the gymnastic machine 1 can selectively actuate free rotations of the first pulley 26' to change, substantially at will, the initial operating position A of the interface 11. In particular, in the preferred embodiment of the gymnastic machine 1 illustrated in FIG. 2, wherein the feeder 23' comprises a spring feeder of the known type, the control device 29 can be economically produced through a control lever 29' carried rotatable by the frame 10 and connected to a Bowden cable 29" suitable, in use, to press the spring of the feeder 23' to return selectively the blocking pin 23 outside each respective hole 34 and enable rotations of the pulley 26'. Alternatively, with reference to a not illustrated variant of the blocking device 22 wherein the feeder 23' is of the electro-mechanical type, the control device 29 can be of the electric and/or electronic type and can comprise, for instance, an electromagnet, which can be used to return selectively the blocking pin 23 outside each respective hole 34 and to enable rotations of the pulley 26'.

In view of the above description and with particular reference to FIG. 3 it is therefore clearly apparent that, by changing selectively the angular operating position of the first pulley 26' and by fixing selectively the pulley 26' to the frame 10 through the blocking device 22, it is possible to define a plurality of initial operating positions A for the interface 11 and therefore the set of the first pulley 26', of the blocking device 22, of the second flexible element/first cable 28 and of the return member, if any, known and therefore illustrated without reference number, of this flexible element 28 can be interpreted as a regulating group 20 for adjusting the initial operating position A of the interface 11.

At this point it should be noted, with particular reference to FIGS. 2 and 3, that the transmission device 17 connecting the interface 11 to the load group 16 preferably comprises a substantially non extendable second flexible element 18, for example a second metallic cable 18, presenting a respective third end 18' rigidly connected to the first pulley 26' and a respective fourth end 18" connected to the load group 16. In particular, the second cable 18 is coupled in a freely slidable manner to the first lever 14', preferably through the interposition of a return element 19 of the known type, for instance a pulley carried in a freely rotatable manner by the first lever 14', arranged in an intermediate position between the interface 11 and the first axis T1 of rotation. In this way, each lifting of the interface 11 relative to the initial operating position A, and therefore each respective rotation of the first lever 14', will be performed against the resistant action of the load group 16. In more detail, in the preferred embodiment illustrated in FIGS. 1 to 3, wherein the load group 16 is of the gravitational type, the fourth end 18" of the second cable 18 is connected to a weight stack 16' so as to associate, in use, with each rotation of the first lever 14' a lifting of this weight stack 16' that will clearly occur against the action of the gravitational force.

At this point, with particular reference to FIG. 3, it should be specified that the first lever 14' is a first-class lever and presents therefore a first and a second arms L1 and L2 that extend in opposite direction relative to the first axis T1 of rotation and present respective given longitudinal extensions that, for the sake of simplicity, hereinafter will be indicated by the same references L1 and L2 of the respective arms. In particular, hereinafter the portion of the first lever 14' comprised between the first axis T1 of rotation and the orthogonal projection of the return member 19 on the first lever 14' will be defined as first arm L1.

In view of the above description, with particular reference to FIG. 3, it is clearly apparent that:

the pulley 26', or any other substantially equivalent mechanical member, can be generically interpreted as a coupling 25 of given type, structurally and functionally connecting the return device 21 and the transmission device 17;

the set of the first lever 14', of the transmission device 17, of the return device 21 and of the given coupling 25 define a closed mechanical circuit 50 associated with the regulating group 20 for adjusting the initial operating position A of the interface 11. In this regard it should be noted that the closed path along which the circuit 50 extends is given by the arrangement, if necessary, of known return members, for example pulleys, associated to the first and second cables 28 and 18. Furthermore, to each change in the operating configuration of the return device 21 corresponds a respective change in the operating configuration of the transmission device 17 and vice versa, because these devices are structurally and functionally coupled through the first pulley 26' inside the circuit 50. In particular, as it is clearly apparent in FIG. 3, the first and second cables 18 and 28 are designed to be wound in the throat of the pulley 26' according to opposite winding directions and therefore, while the user regulates the initial operating position A of the interface 11, to each rotation of the pulley 26' a winding will necessary correspond of the second cable 18 and an unwinding of the first cable 28 or, alternatively, a winding of the first cable 28 and an unwinding of the second cable 18.

At this point it is essential to note that hereinafter the expression "effective length" of a flexible element/cable coupled with the pulley 26' will be used to indicate the longitudinal extension of the portion of this flexible element/cable extending between the detachment point from the first pulley 26' and the end of this flexible element/cable arranged at opposite side from the pulley 26'. Therefore, in view of the above description, to each rotation by a given angle $\alpha$ of the first pulley 26' around the first axis T1 of rotation corresponds a change in the effective length of the first cable 28 equal to $\alpha R$, wherein R represents the extension of the radius of the first pulley 26', and an opposite change in the effective length of the second cable 18. At this point it should be noted that, by adequately dimensioning the value of the ratio between the longitudinal extensions of the first and the second arms L1 and L2 of the first lever 14', the regulating group 20 allows the user to adjust the operating position A of the interface 11 without affecting the load group 16. In particular, this value of the ratio between the longitudinal extensions of the first and second arms L1 and L2 of the first lever 14' is set, during the designing phase of the gymnastic machine 1, based upon the configuration of the circuit 50 and, in particular, based on the configuration of the return members associated with the transmission device 17 and therefore with the circuit 50. In more detail, with reference to the example configuration illustrated in FIG. 3, the ratio between the longitudinal extensions of the first and second arms L1 and L2 of the first lever 14' is preferably set so that each change in the height of the second end 28" of the first cable 28, caused by a lifting/lowering of the interface 11, is substantially equivalent to the change in the height of the return member 19. In this regard it should be noted that in the embodiment of FIG. 3 this operating condition is obtained by giving the first arm L1 a longitudinal extension substantially equivalent to the longitudinal extension of the second arm L2. In this way it is possible to maintain unchanged the height of the height stack 16' during regulating operations for adjusting the initial operating position A of the interface 11 and, at the same time, to maintain the cable 18 stably subjected to a constant tension, exerted by the weight stack 16', independently of the initial operating position A selected by the user through the regulating group 20. In this way it is possible to prevent injuries to the user that could be caused by quickly undoing the resistant action exerted by the load group 16 in the case that the second cable 18 is not adequately tensioned during the phases of adjusting the initial operating position A or during the execution of physical exercises through the gymnastic machine 1.

Furthermore, with particular reference to FIG. 2, it should be noted that the pulley 26' and the majority of the return members defining the path of the circuit 50 can be housed in a service zone 6, which is preferably arranged below the exercising station 5 and is delimited at the top by a safety panel 6' which is also able, in use, to act as a footrest for the user of the gymnastic machine 1. The main mechanical components of the regulating group 20 are therefore housed and protected in a substantially closed space that, for even more safety, cannot be unintentionally achieved by the user.

Furthermore, with reference to FIGS. 1 and 2, it should be noted that the first pulley 26' presents on a respective upper face visual indicators 32 to facilitate the detection of the initial operating position A and to allow reproducing it in any instant. These visual indicators 32 can comprise, for instance, graphic labels showing numbers in increasing or decreasing order. In more detail, each of these graphic labels is associated with a respective hole 24 so that it is possible to associated a given number to each given angular operating position of the first pulley 26'. In more detail, the panel 6' delimiting the service zone 5 presents preferably an opening 31 to allow the user to see the visual indicator 32 associated with the hole 24 correctly engaged by the blocking pin 23. The set of the visual indicators 32 and of the opening 31, if any, can be therefore interpreted as a displaying group 30 for displaying the angular position of the pulley 26'.

The use of the gymnastic machine 1 and of the respective regulating group 20 is clearly apparent from the description above and does not require further explanations; however it may be advisable to highlight some advantages of the use of the regulating group 20 according to the present invention.

First of all, the regulating group 20 gives the user of the gymnastic machine 1 the possibility to define substantially at will an initial operating position A of the interface 11 according to his/her anthropometric proportions and according to the desired training modes. Furthermore, the return device 21 and the coupling between the return device 21 and the transmission device 17 in a closed circuit 50 allows to prevent injuries to the user due to discontinuities in the execution of the exercise and in particular due to sudden changes in the action exerted by the load group 12. Lastly, the use of the regulating group 20 according to the present invention allows to arrange the coupling 25 between the transmission device 17 and the return device 21 in a respective service zone 6 arranged remotely from the exercising station 5. It is therefore possible to produce gymnastic machines 1 intrinsically safer for the user and substantially less bulky and therefore suitable to present a slenderer and more elegant design.

Figure 4:
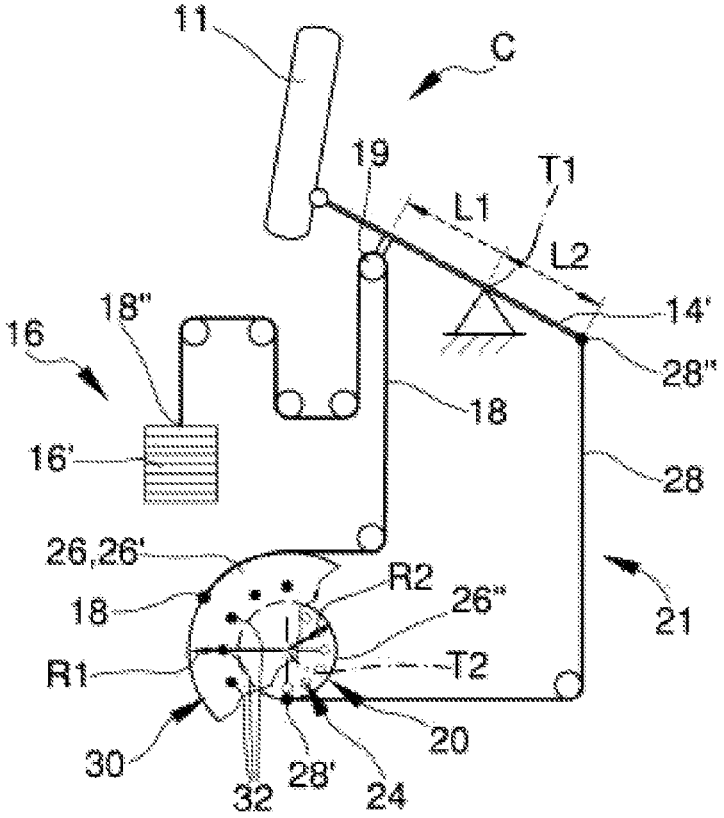
FIG. 4 schematically illustrates a second preferred embodiment of a regulating group according to the present invention.
Figure 5:
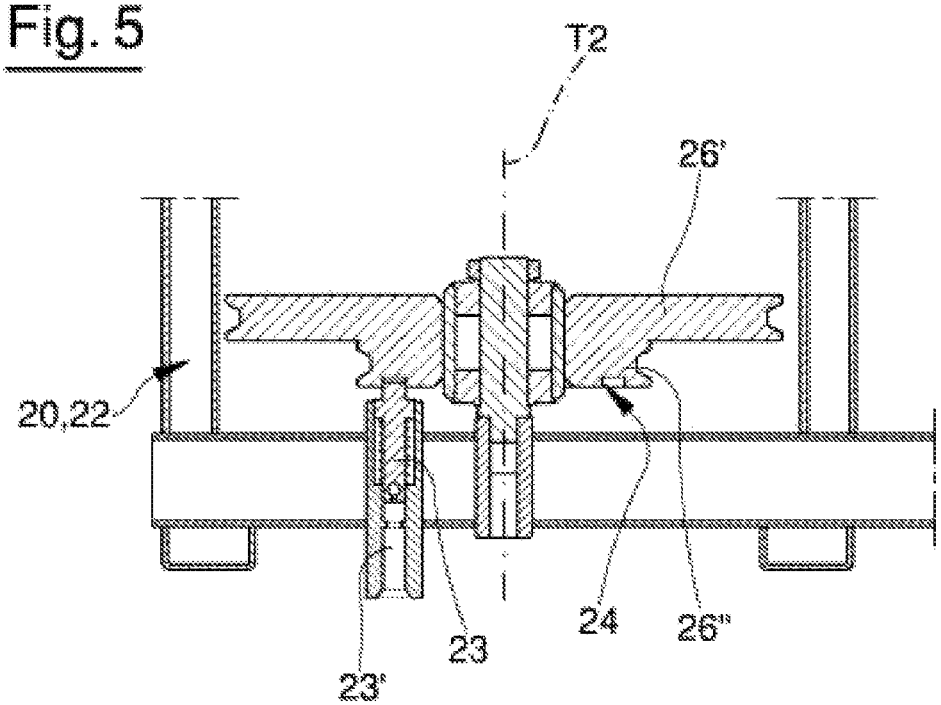
FIG. 5 illustrates a second preferred embodiment of a detail of FIG. 2 in enlarged scale.

Lastly, it is clearly apparent that modifications and variants can be made to the gymnastic machine 1 and to the regulating group 20 described and illustrated herein, without however departing from the protective scope of the present invention. It is possible, for instance, to produce a first variant of the gymnastic machine 1, wherein the first lever 14' is dimensioned differently from what illustrated in FIG. 3 and in particular presents a value of the ratio between the longitudinal extensions of the respective first and second arms L1 and L2 different than the previously described preferred value 1:1. With particular reference to FIGS. 4 and 5, in this first variant of the gymnastic machine 1 the regulating group 20 comprises a first and a second coaxial pulleys 26' and 26" rigidly coupled and carried by the frame 10 in a freely rotatable manner. In particular, the third end 18' of the second cable 18 is preferably rigidly coupled to the first pulley 26', while the first end 28' of the first cable 28 is rigidly connected to the second pulley 26" so that, in use, the first and second cables 28 and 18 are able to be wound around the respective second and first pulleys 26" and 26' according to opposite winding directions. In more detail, these first and second pulleys 26' and 26" present respectively a first and a second radius R1 and R2, whose longitudinal extensions are correlated with the longitudinal extensions of the first and second arms L1 and L2 of the first lever 14'. With particular reference to the scheme of FIG. 4, given just by way of example, the longitudinal extension of the first and second radii R1 and R2 are preferably linked to the longitudinal extensions of the first and second arms L1 and L2 according to the proportion $L1:L2 \propto R1:R2$ and, more in particular, according to the preferred identity relation $L1:L2=R1:R2$.

It should be noted that also in this first variant of the gymnastic machine 1 at least one of the first and second pulleys 26' and 26" preferably presents a plurality of stepped holes 24 obtained along a respective inner circumference and arranged to be engaged by the blocking pin 23. Alternatively, instead of the blocking device 22 illustrated above, it is possible to associated with the regulating group 20 a blocking device 22 provided with a brake 27 of the known type suitable, in use, to connect to the frame 10 the first and third end 28' and 18', clamping at least one first or second pulley 26' or 26" or, alternatively, the rotation member supporting rotatable this/these pulley/s. In particular, contrarily to what occurs in the common bicycle braking systems, this brake is generally engaged to prevent rotations of the first and second pulleys 26' and 26", and it can be selectively disengaged by acting on a control device 29 as that illustrated above and comprising a control lever 29' carried rotatable by the frame 10 and a Bowden cable interposed between this control lever 29' and the brake 27.

Lastly, it is possible to produce a second variant, not illustrated, of the gymnastic machine 1, wherein the first pulley 26' or the pair of first and second pulleys 26' and 26" is replaced with a third lever 26'" carried in a freely rotatable manner by the frame 10 around a second axis T2 of rotation arranged perpendicularly to this third lever 26'". This third lever 26'" is a first-class lever and presents a third and a fourth arms L3 and L4 arranged at opposite sides relative to the second axis T2 of rotation. In particular, in this second variant of the gymnastic machine 1, the first and the third end 28' and 18' are coupled respectively to the two end portions of the third lever 26'". In more detail, it should be specified that also in this second variant the value of the ratio between the longitudinal extensions of the first and second arms L1 and L2, and the value of the ration between the longitudinal extensions of the first and second arms L3 and L4 are correlated to one another so that to each rotation of the third lever 26''' corresponds an equal and opposite change in the effective length of the first and second cable 28 and 18. It should be however specified that in the case of this second variant, the effective length of the cable 28 will be conveniently defined as the distance between the second end 28'' and any one of the return members/pulleys engaged by the cable 28.

At this point it should be noted that the first pulley 26' of the first preferred embodiment of the gymnastic machine 1 has a function substantially equivalent to that of the rotatable member composed by the rigid coupling between the first and second pulleys 26' and 26'' or of the third lever 26''' respectively in the first and in the second above illustrated variants of the gymnastic machine 1. In view of the above description, both the first pulley 26' and the coupling of the first and second pulleys 26' and 26'' and the third lever 26''' can be therefore interpreted as a regulating member 26 carried rotatable by the frame 10 around the second axis T2 of rotation and usable, in use, to couple in a closed mechanical circuit the first and second cables 28 and 18 and to vary in a given manner the respective effective lengths thereof as the initial operating position A of the interface 11 varies.

Lastly, in view of the above description, it is clearly apparent that the gymnastic machine 1 and the regulating group 20 allow to solve the highlighted technical problem, i.e. they allow to adjust the initial operating position of the interface of a gymnastic machine in a simple, reproducible and safe manner for each respective user.

What is claimed is:

1. A regulating group for adjusting the initial operating position of a user interface associated with an exercise machine, wherein said interface is shaped to be engaged by a given body portion of a user of the exercise machine, said exercise machine comprising: a frame; load means; transmission means for connecting said load means to said interface; and support means for carrying said interface movable relative to said frame; said regulating group comprising:

return means for defining, at said initial operating position, a stop for the movement of said interface relative to said frame; said return means adapted to be connected to said transmission means through a coupling, so that at each variation in said initial operating position actuated through said return means corresponds a respective variation in the operating configuration of said transmission means;

wherein said coupling includes a rotatable regulating member stably coupled to said return means and to said transmission means;

wherein said regulating member being selectively blockable in a plurality of respective angular operating positions, each of which is associated with a corresponding said initial operating position of said interface, wherein said support means comprises a first support member rotatably carried by said frame around a respective first axis of rotation; and wherein said return means comprises a first substantially non extendable flexible element, which is coupled to said first support member at an opposite side from said interface relative to said first axis of rotation and includes a respective first end connected to said regulating member.

2. A regulating group according to claim 1, wherein said transmission means comprises a substantially non extendable second flexible element including a respective third end connected to said regulating member and a respective fourth end connected to said load means; and wherein said second flexible element being coupled in a substantially slidable manner to said first support member at the same side of said interface relative to said first axis of rotation in order to transmit the resistant action of said load means to said interface.

3. A regulating group according to claim 2, wherein each said variation in the operating configuration of said transmission means, associated with a respective variation in said initial operating position actuated through said return means, includes a variation in the effective length of said second flexible element.

4. A regulating group according to claim 2, wherein said regulating member comprises a first pulley carried in a freely rotatable manner by said frame; and wherein said first and third ends being rigidly connected to said first pulley so that with each variation in said initial operating position of said interface corresponds a respective action of partial winding/unwinding of said first and second flexible elements around said first pulley.

5. A regulating group according to claim 2, wherein said regulating member comprises a first and a second coaxial pulleys, reciprocally coupled in an integral manner and carried in a freely rotatable manner by said frame; and wherein said first and third ends being respectively connected to said second and first pulleys so that with each variation in said initial operating position of said interface corresponds a respective action of partial winding/unwinding of said first and second flexible elements around the respective second and first pulleys.

6. A regulating group according to claim 5, wherein said first support member comprises a first first-class lever including respective first and second arms extending at opposite sides relative to the first axis of rotation; and wherein the ratio between the longitudinal extensions of said first and second arms being substantially proportional to the ratio between the longitudinal extensions of the first and second radii of said first and second pulleys.

7. A regulating group according to 2, wherein said rotatable regulating member comprises a first first-class lever carried in a freely rotatable manner by said frame around a respective second axis of rotation arranged perpendicularly to said first lever; and wherein said first and third ends being rigidly connected to said first lever at opposite sides relative to said second axis of rotation.

8. A regulating group according to claim 1, further comprising blocking means designed to constrain said regulating member in a respective angular operating position relative to said frame.

9. A regulating group according to claim 8, wherein said blocking means comprises a brake adapted to prevent said regulating member from rotating; and wherein the regulating group further comprises control means for selectively disengaging said brake and for enabling free rotations of said regulating member.

10. A regulating group according to claim 2, further comprising:

blocking means designed to constrain said regulating member in a respective angular operating position relative to said frame;

control means for selectively disengaging said blocking means and for enabling free rotations of said regulating member;

wherein at least one said first or one said second pulley includes a plurality of stepped holes obtained along a respective inner circumference;

wherein said blocking means comprises a blocking pin adapted to engage each said hole to constrain said regulating member in a respective angular operating position, and a feeder adapted to maintain said blocking pin stably engaged in each respective said hole; and wherein control means of said feeder adapted to return said blocking pin outside each respective said hole and to enable free rotations of said regulating member.

11. A regulating group according to claim 9, wherein said control means comprises a control member connected to a Bowden cable, which connects said control member to said blocking means of said regulating member.

12. A regulating group according to claim 10, wherein said control means comprises a control member connected to a Bowden cable, which connects said control member to said blocking means of said regulating member.

13. A regulating group according to claim 1, wherein said support member and said coupling are adapted so that said second flexible element is constantly maintained tensioned by said load group during each variation of said initial operating position of said interface.

14. A regulating group according to claim 2, wherein with each variation of said initial operating position of said interface corresponds a first variation in the effective length of the first flexible element and a second variation in the effective length of said second flexible element; and wherein said second variation being of equal length as, and of opposite direction to, said first variation.

15. A regulating group according to claim 1, further comprising displaying means for displaying the angular operating position of said regulating member.

16. A regulating group according to claim 15, wherein said displaying means comprises visual indicator elements arranged in a stepped manner on said regulating member.

* * * * *